United States Patent [19]

Hickman et al.

[11] Patent Number: 4,909,006

[45] Date of Patent: Mar. 20, 1990

[54] FASCIA ASSEMBLY AND METHOD OF MAKING SAME

[75] Inventors: John B. Hickman, Biltmore Forest; Nelson M. Ferg, Asheville, both of N.C.

[73] Assignee: W. P. Hickman Company, Asheville, N.C.

[21] Appl. No.: 361,338

[22] Filed: Jun. 5, 1989

Related U.S. Application Data

[62] Division of Ser. No. 246,214, Sep. 19, 1988, Pat. No. 4,890,426.

[51] Int. Cl.[4] ..... E04B 7/00

[52] U.S. Cl. ..... 52/288; 52/716; 52/287

[58] Field of Search ..... 52/287, 288, 716

[56] References Cited

U.S. PATENT DOCUMENTS

| | | | |
|---|---|---|---|
| 2,541,768 | 2/1951 | Keller | 52/287 |
| 3,318,061 | 5/1967 | Stentz | 52/254 X |
| 4,430,833 | 2/1984 | Balzer et al. | 52/287 X |
| 4,719,733 | 1/1988 | Seles | 52/288 |

FOREIGN PATENT DOCUMENTS

| | | | |
|---|---|---|---|
| 15533 | of 1899 | United Kingdom | 52/288 |

*Primary Examiner*—David A. Scherbel
*Assistant Examiner*—Lan Mai
*Attorney, Agent, or Firm*—Harness, Dickey & Pierce

[57] ABSTRACT

A sheet material assembly for forming a fascia assembly, raised roof edge assembly, coping assembly, or other such building component assembly, is disclosed. Such assembly includes at least a longitudinally-extending generally vertical outer face member, and frequently a longitudinally-extending, generally vertical inner face member spaced laterally away from the outer face member with an intermediate member disposed between the spaced-apart inner and outer face members to interconnect the inner and outer face members. Preferably, both or at least one of the face members has a flange portion located generally at an upper edge, with the intermediate member or an adjacent portion of the face member being secured to the flange portion. Such an assembly facilitates the forming of an angulated configuration, or a curved arcuate configuration, in order to form a "corner" portion of the assembly. In this regard, an insert member is also disclosed for filling any unsightly notches or gaps in laterally-protruding portions of the components and is preferably molded from a resilient material of a color that is complementary to the finished sheet material components.

4 Claims, 5 Drawing Sheets

FIG. 7.
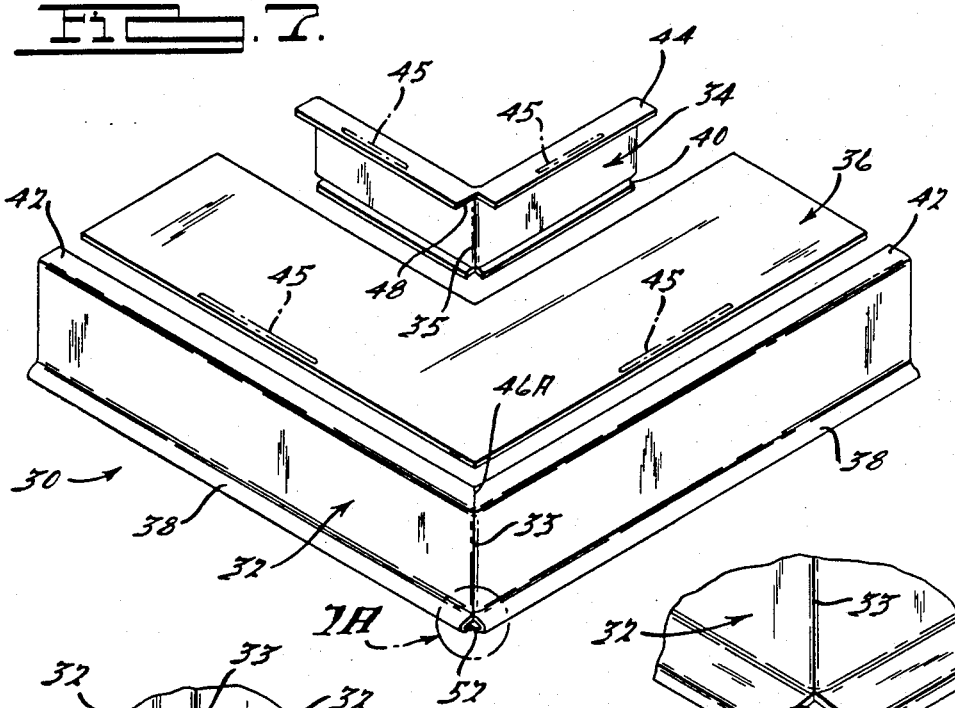
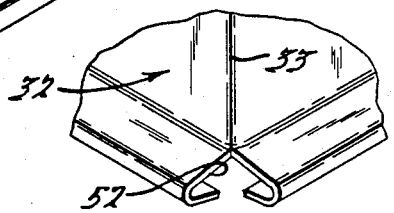
FIG. 7A.
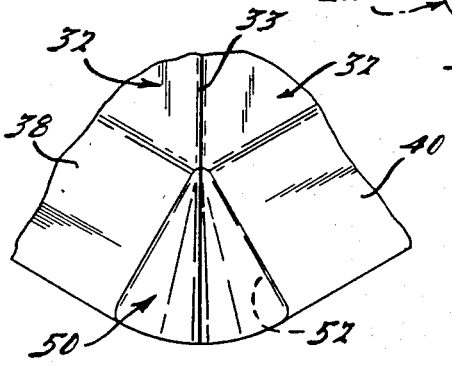
FIG. 8.
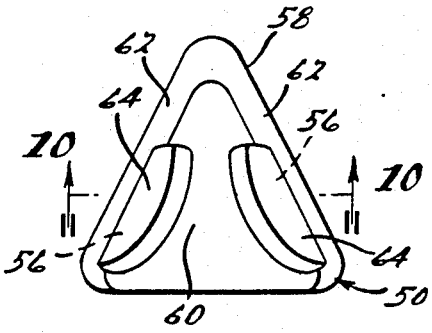
FIG. 9.
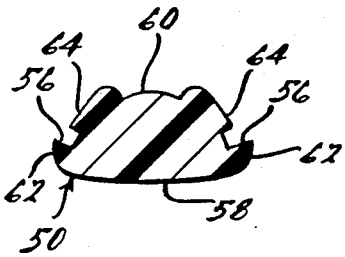
FIG. 10.

FASCIA ASSEMBLY AND METHOD OF MAKING SAME

This is a division of U.S. patent application Ser. No. 246,214, filed Sept. 19, 1988 now patent No. 4,890,426.

BACKGROUND AND SUMMARY OF THE INVENTION

The invention relates generally to an apparatus and method for forming a fascia assembly, raised roof edge, gravel stop, or the like, adapted for installation on a building structure, and more particularly to such assemblies wherein an angulated corner or arcuate curve is desired in the assembly. In this regard, the term "fascia assembly", as used herein, generally includes coping assemblies, raised roof edges, gravel stops, or other sheet material components or trim parts for building structures or the like wherein an outward face or panel is presented.

Typically, corners of sheet metal or other fascia sheet material parts, such as coping assemblies, roof edge assemblies, gravel stop, and the like, have been fabricated by miter-cutting straight lengths of preformed components and welding the miter-cut components together in order to form an angulated corner. In some instances, however, corners are fabricated by making a cut in a laterally protruding lip or drip edge and folding or bending the straight components (such as fascias, for example) in order to form the corner. These methods of fabricating corners in sheet metal components of this type have frequently been found to be undesirable, especially where the assemblies are made from pre-finished, pre-fabricated materials. In some cases, the finished materials can be marred or otherwise damaged during the cutting and forming operations, thus requiring the corner joints to be re-finished after the welding operation.

In addition to the problems associated with appearance and finishing discussed above, the fabrication of angulated or arcuate corners or curves in such building components has proved to be a difficult and labor-intensive operation, frequently without sufficiently satisfactory end results. Also, it has been found that such corners are frequently susceptible to leakage, which in many instances defeats the purpose of the coping assembly, raised roof edge assembly, fascia, or the like. Thus, for these reasons, as well as those discussed above, the need has arisen for a less costly and less labor-intensive way of fabricating such angulated or curved corners from pre-fabricated and pre-finished sheet material components in a manner requiring little or no post-finishing and rendering an improved end product, both functionally and aesthetically.

In accordance with the present invention, a fascia assembly, which includes raised roof edge assemblies, gravel stop, coping assemblies, or other such assemblies, adapted for installation on a building structure, for example, includes a longitudinally-extending, generally vertical outer face member, and typically a longitudinally-extending, generally vertical inner face member spaced laterally away from the outer face member. An intermediate member is disposed adjacent the outer member or between the spaced-apart inner and outer face members to laterally interconnect the inner and outer face members. Each of the inner and outer face members include flange portions extending laterally or transversely therealong and located generally at their respective upper edges. The flange portions on the inner and outer face members are oriented generally toward one another, with the above-mentioned intermediate member being secured to the flange portions of the respective inner and outer face members. It should be noted that the inner and outer members can also include lips, ridges, or other shaped portions adjacent a generally vertical planar portion, and that such shaped portions can even be disposed between such planar portions and the flange portions.

Where a corner configuration is desired, the inner and outer face members are each fabricated in an angulated configuration, extending along an angulated longitudinal path in order to form a corner portion of the coping assembly. The intermediate member in such cases is also fabricted in an angulated configuration in order to laterally interconnect the inner and outer face members along the angulated longitudinal path. Typically, since the inner and outer face members are each composed of a sheet material, such as sheet steel or aluminum, for example, and bent along a generally vertical bend line into the angulated configuration, the above-mentioned flange portions of each of the inner and outer face members are required to have laterally-extending cuts therein adjacent the bend line in order to accommodate the bending of the inner and outer face members into the angulated configuration. Where one of the face members is required to be bent laterally in the same lateral direction toward which its flange portion is oriented, such laterally-extending cut or cuts must be made in such a manner as to define a generally triangular-shaped opening, notch, or gap in the flange portion, with such opening being closed up when the face member is bent laterally into its angulated configuration. Similarly, where one or both of the face members includes a lower lip or drip edge extending generally laterally, or at least transversely with respect to the vertical portion of the face member, such laterally-extending cut becomes spread apart to define a generally triangular-shaped opening, notch, or gap upon completion of the bending of the face member.

In order to avoid leaving an unsightly opening or gap in the lower lip or drip edge mentioned above, the present invention provides an insert member adapted to be inserted into the opening in order to substantially fill the opening upon completion of the fabrication operations. Preferably, such an insert member is composed of a resilient, elastomeric material, including a body portion having lateral edges with grooves formed therein. Such grooves are adapted to receive the sheet material of the face member on opposite sides of the opening in the sheet material in order to retain the insert member in the opening. Although the insert member is optionally secured to the sheet material by way of an adhesive, the width of the above-mentioned grooves is preferably smaller than the thickness of the adjacent sheet material, with the resilient, elastomeric material of the insert member resiliently deflecting adjacent the grooves when the insert member is inserted into the opening or gap in order to resiliently grip opposite sides of the sheet material adjacent the opening or gap.

In another embodiment, the preferably resilient and elastomeric insert member includes a body portion having tabs or protrusions extending outwardly from the body portion. Such tabs are resiliently received within an opening formed in the adjacent sheet material components, such as the above-described inner or outer members, for example. Such openings can be defined by a folded-under or bent-under drip edge configuration, for example. In either this embodiment or the embodiment discussed above, however, it is not necessary that the fascia assembly includes both an inner and outer member as discussed above. The insert member according to the present invention is applicable in a wide variety of fascia assemblies or structures wherein the above-discussed gap results from the fabrication of a corner or other angulated configuration.

The features discussed above, as well as additional objects, advantages, and features of the present invention, will become more apparent from the following description and appended claims, taken in conjunction with the accompanying drawings.

BRIEF DESCRIPTION OF THE DRAWINGS

FIG. 7 is a partial exploded perspective view of the fascia assembly of FIG. 2, shown for purposes of illustrating the method of fabricating such an assembly.

FIG. 7A is an enlarged and detailed view of the circled portion of FIG. 7, illustrating the corner of a lower lip or drip edge, for example, for any of the assemblies shown in FIGS. 2 through 7.

FIG. 8 is an enlarged and detailed view of the corner of a lower lip or drip edge for any of the fascia assemblies shown in FIGS. 2 through 7, and is similar to that of FIG. 7A, but further illustrates an insert member for filling a gap in such a lower lip or drip edge.

FIG. 9 is a rear or inner side view of the insert member of FIG. 8.

FIG. 10 is a cross-sectional view, taken generally along line 10—10 of FIG. 9.

DETAILED DESCRIPTION OF THE PREFERRED EMBODIMENTS

Figure 1:
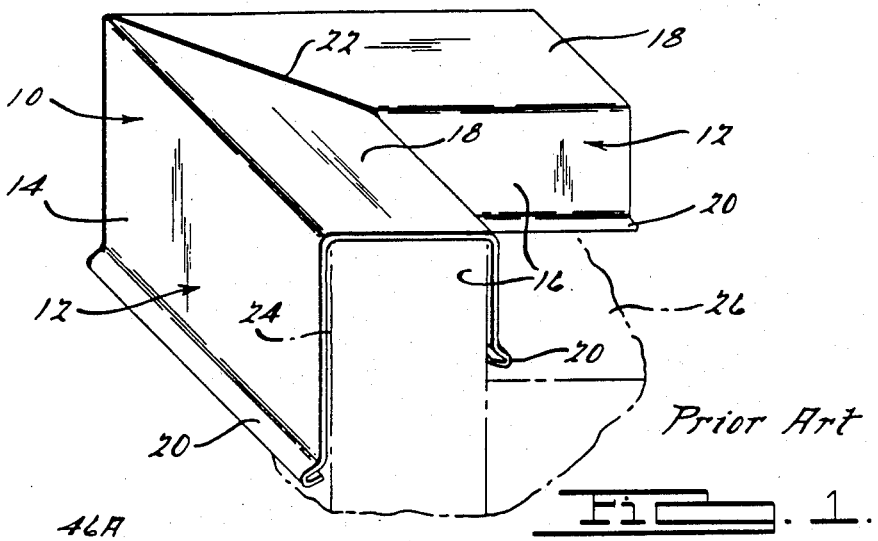
FIG. 1 is a partial perspective view of a fascia assembly having a corner configuration in accordance with the prior art.

FIGS. 1 through 16 depict various exemplary embodiments of coping, roof edge, gravel stop, fascia, or other such assemblies acccording to the present invention, all of which are designated herein as "fascia assemblies". Such exemplary embodiments are shown in the drawings for purposes of illustration only, and one skilled in the art will readily recognize that the principles of the present invention are equally applicable to assemblies other than those shown for purposes of illustration in the drawings, as well as to other sheet material components.

FIG. 1 illustrates a typical example of a fascia assembly formed in accordance with the principles of the prior art, as discussed above. A prior art fascia assembly 10 typically includes a number of generally U-shaped coping sections 12, each of which includes an outer face portion 14, an inner face portion 16, and an intermediate portion 18 interconnecting the inner and outer face portions 14 and 16, respectively. Frequently, drip edges 20 are fabricated at the lower edges of the inner and outer face portions 14 and 16, respectively, in order to facilitate the drainage of water away from the fascia assembly and the building structure.

In order to fabricate the corner in the coping assembly 10 shown in FIG. 1, straight sections of the coping sections 12 where miter-cut at an appropriate angle transversely across the coping sections 12, and welded together at the joint 22 shown in FIG. 1. The prior art fascia assembly 10 could then be placed and secured onto a raised roof edge 24 on the roof 26 of a building structure, for example. As mentioned above, however, such prior art constructions presented a variety of difficulties and sometimes undesirable results, which the present invention seeks to overcome.

Figure 2:
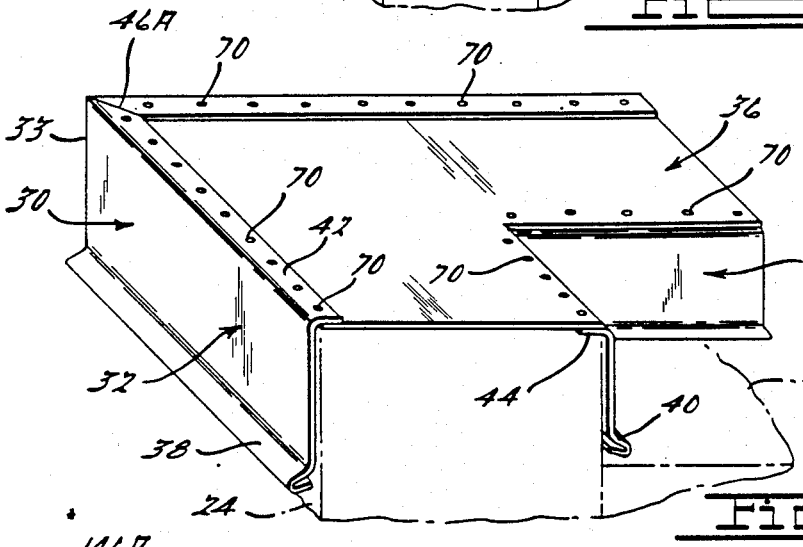
FIG. 2 is a partial perspective view of a fascia assembly similar to that of FIG. 1, but employing the various advantageous features of the present invention.

In FIG. 2, one example of a preferred construction for a fascia assembly 30 is illustrated. The fascia assembly 30 includes an outer face member 32, an inner face member 34, and an intermediate member 36 laterally interconnecting the inner and outer face members 32 and 34, respectively. The intermediate member 36, which can be flat and horizontal as shown for purposes of illustration in FIG. 2, is secured by any of a number of known fastening methods to a flange 42 on the outer face member 32 and a flange 44 on the inner face member 34.

One method by which such fastening or securement can be accomplished in accordance with the present invention is by way of interlocking discontinuities 70 formed in the sheet material of the intermediate member 36 and the respective flanges 42 and 44 of the outer and inner face members 32 and 34, respectively. One preferred example of a joint having such interlocking discontinuities, which is especially desirable where a leak-proof joint is desired, is disclosed in U.S. Pat. No. 4,459,735. It should be noted, however, that conventional screws, rivets, or others of a wide variety of fastening means, can alternately be employed in order to secure the intermediate member 36 to the flanges 42 and 44.

In order to fabricate the angulated configuration of the fascia assembly 30, which extends along an angulated longitudinal path in order to define such a corner, the outer face member 32 must be bent along a bend line 33, and similarly the inner face member 34 must be bent along a bend line 35 (see FIG. 7). Similarly, the intermediate member 36 must be fabricated in a complementary angulated configuration (such as the L-shaped configuration shown in FIG. 2), thereby allowing the intermediate member 36 to be secured to the flanges 42 and 44 on both legs of the corner configuration of the fascia assembly 30.

In this regard, it should be pointed out that the various fascia assemblies shown for purposes of illustration in the drawings are constructed with the outer flange 44 disposed in an overlapping relationship with the intermediate member 36, and with the inner flange 44 disposed in an underlapping relationship with the intermediate member 36. This provides for water run-off toward the inner side of the exemplary raised roof edge 24 and onto the roof 26, where roof drains or other suitable apparatuses for disposing of such water are typically disposed. If, on the other hand, it is desired that such run-off be directed toward the outer periphery of the building structure, such relationship between the inner and outer flanges 42 and 44 and the intermediate member 36 can optionally be reversed.

In addition, in order to allow the above-described formation of the angulated corner of the fascia assembly 30 shown in FIG. 2, the drip edges 38 and 40 on the outer and inner face members 32 and 34, respectively, as well as the respective flanges 42 and 44, must be cut in a manner described in more detail below, thus facilitating the bending of the outer and inner face members 32 and 34, respectively.

Figure 3:
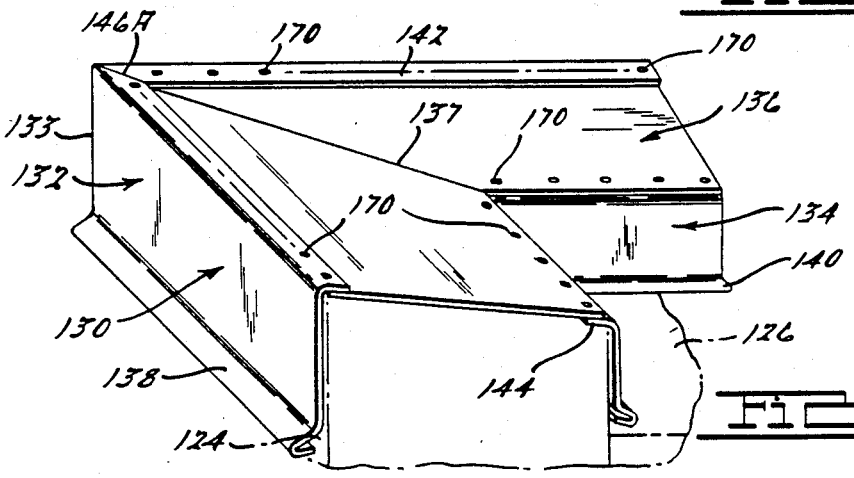
FIG. 3 is a view similar to that of FIG. 2, but illustrating a variation in a fascia assembly according to the present invention.

FIG. 3 illustrates an alternate fascia assembly 130, which is similar in virtually all respects to the fascia assembly 30 shown in FIG. 2, with the exception that the intermediate member 136 is sloped inwardly toward the roof 126, and thus includes a slightly bent or articulated configuration of intermediate member 136 about the bend line 137 shown in FIG. 3.

Figure 4:
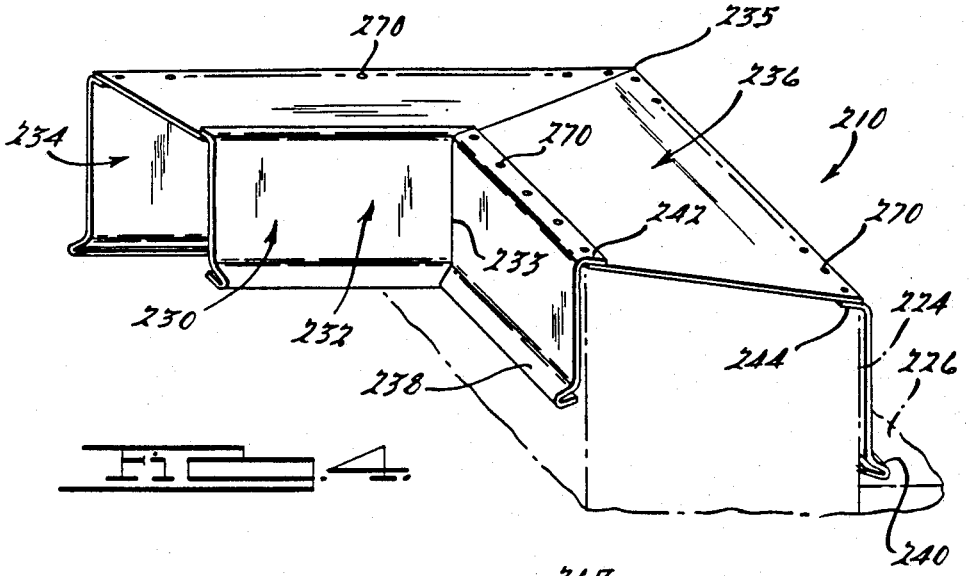
FIG. 4 is a view similar to that of FIGS. 2 and 3, but illustrating still another variation in a fascia assembly according to the present invention.

FIG. 4 shows a fascia assembly 230, which is similar in virtually all respects to that of FIGS. 2 and 4, except that the portion of the fascia assembly 230 shown in FIG. 4 includes an angulated corner, which can be described as an "inside corner", rather than the oppositely-directed "outside corners" shown in FIGS. 2 and 3. This terminology "inside corner" is intended to apply to a corner configuration, where the outer face members 32 on opposite sides of the corner define an angle of less than 180 degrees with respect to one another on the outside of the building structure. Conversely, the terminology "outside corner" is intended to refer to a configuration where the outer face members define an angle of less than 180 degrees with respect to one another toward the inside of the building structure. It should further be noted that any of the exemplary constructions shown in FIGS. 2 through 4 can include intermediate members that are horizontal, outwardly and downwardly sloping, or inwardly and downwardly sloping.

Figure 5:
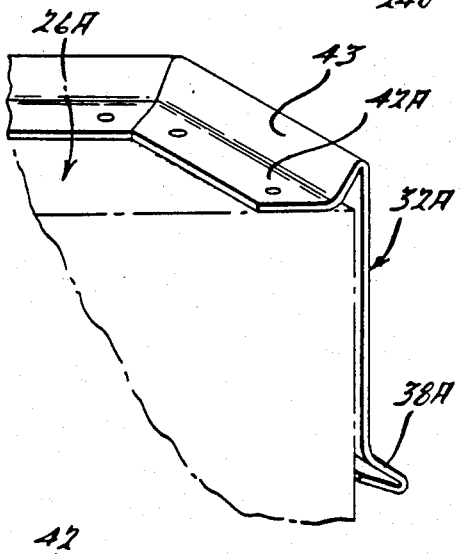
FIG. 5 is a cross-sectional view of an optional construction for one of the face members in the fascia assemblies of FIGS. 2 through 4.

FIG. 5 illustrates a cross-sectional shape or configuration of an optional face member usable in any of the exemplary embodiments shown in FIGS. 2 through 5. Such optional cross-sectional shape or configuration is substantially the same as that shown in FIGS. 2 through 4, with the exception of the addition of an upper lip portion 43 formed generally at the upper vertical edge adjacent the flange portion 42A.

Figure 6:
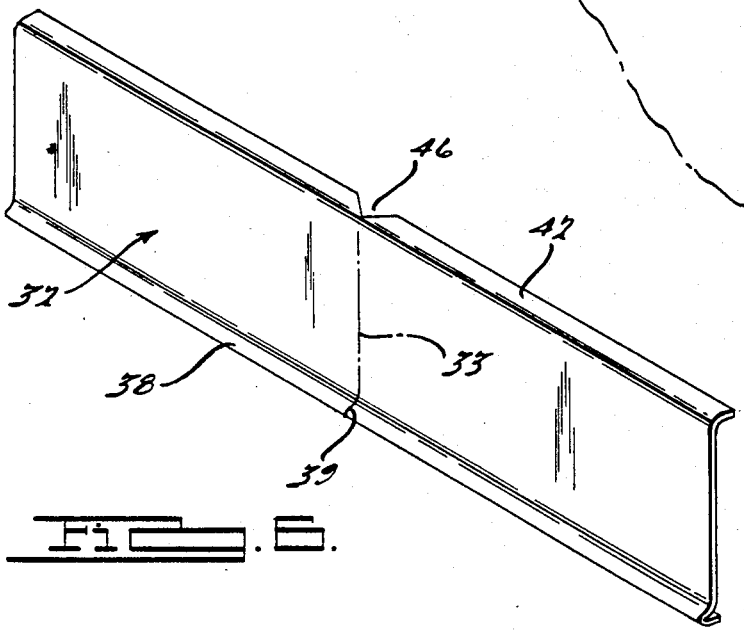
FIG. 6 is a partial perspective of one of the face members for the fascia assemblies shown in FIGS. 2 through 4, and illustrating a first step in the method of fabricating such assemblies.
Figure 11:
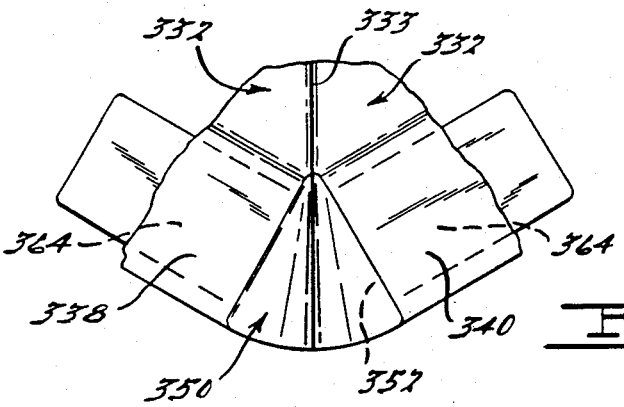
FIG. 11 is a view similar to that of FIG. 8, but illustrates another embodiment of such an insert member.
Figure 12:
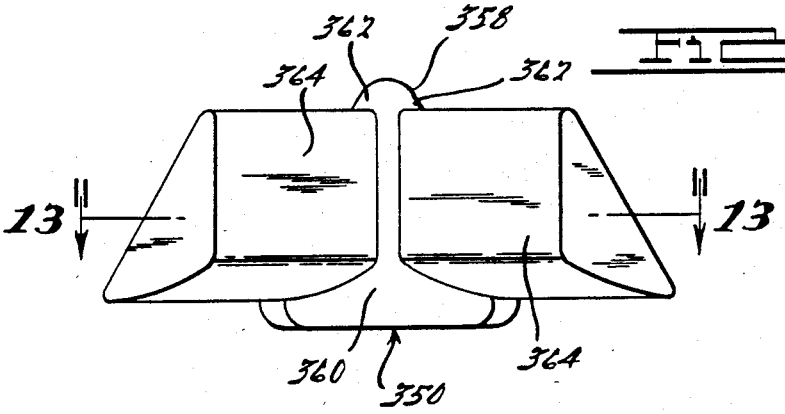
FIG. 12 is a view similar to that of FIG. 9, but illustrating a rear or inner side view of the insert member of FIG. 11.
Figure 13:
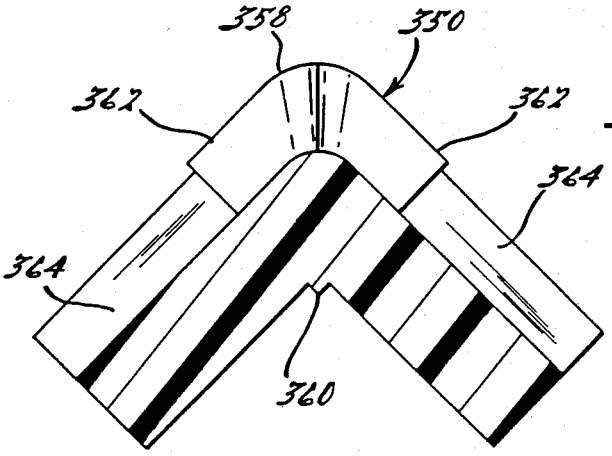
FIG. 13 is a view similar to that of FIG. 10, but illustrating a cross-sectional view taken generally along line 13—13 of FIG. 12.
Figure 14:
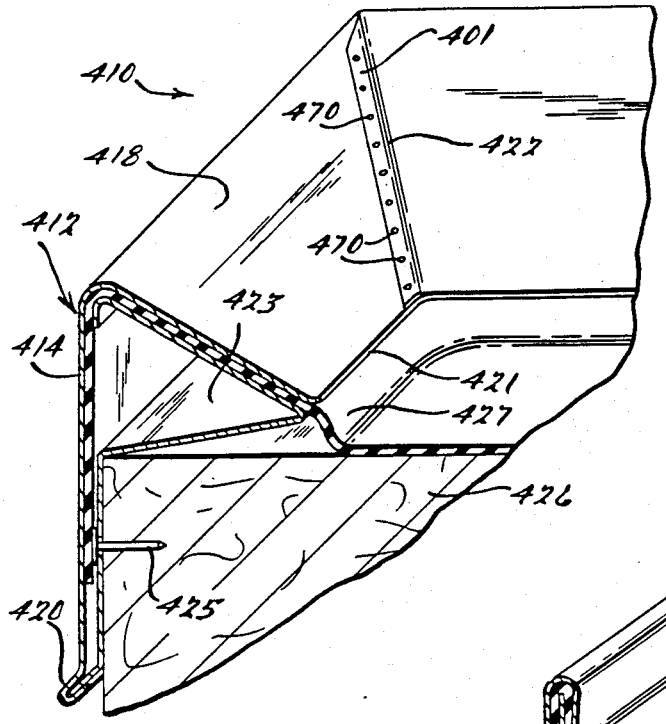
FIG. 14 is a view similar to that of FIGS. 1 through 3, but illustrating an application of the present invention in another type of angulated fascia assembly, such as a gravel stop, or other raised roof edge structure.

FIGS. 6 through 7A perhaps best illustrate the method of fabricating a fascia assembly in accordance with the present invention. For purposes of illustrating such method, the various components of the fascia assembly 30 shown in FIG. 2 are illustrated in FIGS. 6 through 7A. One skilled in the art will readily recognize, however, that the same principles of the method illustrated in FIGS. 6 through 7A are equally applicable to other embodiments of the present invention.

In FIG. 6, a straight section of the outer face member 32 is illustrated with a transverse or laterally-extending triangular notch or gap 46 being made in the flange portion 42. Similarly, a single cut or kerf cut 39 is made in the lower drip edge 40, which extends transversely in a generally outer lateral direction, opposite of the generally inward lateral direction in which the flange portion 42 extends. Such notches or gaps 46 and cuts 39 facilitate the bending of the outer face member 32 along the bend line 33 in order to fabricate the angulated longitudinally-extending configuration of the outer face member 32, as shown in FIGS. 2 and 7. In this regard, the generally triangular-shaped notch or gap 46 closes during such bending in order to form the closed joint 46A shown in FIG. 2. Similarly, but in an opposite manner, the kerf cut 39 in the drip edge 38 shown in FIG. 6 spreads apart during bending along the bend line 33 in order to define the outer triangular-shaped gap 52 shown in FIGS. 7 and 7A. As will be readily recognized by one skilled in the art, similar but opposite cuts, and the resultant closings and spreadings thereof, occur in the inner face member 34 during bending along the bend line 35, shown for purposes of illustration in FIG. 7.

Once the longitudinally-extending configurations of the outer and inner face members 32 and 34, respectively, have been accomplished, these components, along with the angulated intermediate member 36, can be assembled in the manner discussed above, and are shown just prior to such assembly in FIG. 7. In this regard, if deemed desirable or necessary in a particular application, one or more beads of sealant 45 can optionally be positioned appropriately as shown in phantom lines in FIG. 7, in order to further contribute to the leakproof construction of the fascia assembly corner apparatus.

In order to fill the generally triangular-shaped notch or gap 52 shown in FIGS. 7 and 7A, or any other such similar opening or gap that would be unsightly or otherwise disadvantageous if left open, the present invention provides an insert member for filling such a gap, a preferred exemplary embodiment of which is the nose piece or insert member 50 shown in FIGS. 8 through 10. The insert member 50 includes a body portion having lateral edges with grooves 56 formed therein and adapted to receive the edges of the sheet material fascia member on opposite sides of the notch or gap (such as the notch or gap 52) in order to retain the insert member 50 in the gap. Preferably, the insert member is formed of a resilient, elastomeric material, such as EPDM rubber, for example. By such a construction, the insert member 50 can be molded in any of a wide variety of colors so as not to require painting or other finishing to adequately match the surrounding coping material.

Preferably, the width of the grooves 56 is somewhat smaller than the thickness of the sheet material of which the fascia members are constructed, thus allowing the resilient and elastomeric material of the insert member 50 to resiliently deflect adjacent the grooves 50 when the insert member is forcibly inserted into the notch or gap, thus resiliently gripping opposite sides of the sheet material adjacent the gap and retaining the insert member 50 therein. Alternately, if desired or deemed necessary in a particular application, the insert member 50 can be retained in the notch or gap 52 by means of a suitable adhesive for bonding the material of the insert member to the sheet material of the adjacent fascia member.

The body of the insert member 50 preferably includes a first outer side 58 and a second opposite or inner side 60, with the first outer side 58 extending laterally outward beyond the second inner side portion 60 in order to form lateral flange portions 62. The flange portions 62, along with laterally outwardly-extending ear portions 64, define the above-mentioned grooves 56.

In the preferred embodiment, such first outer side 58 is preferably of a convex or angulated shape in order to conform to the angulated corner configuration of the fascia assembly. In addition, in order to better fill the notch or gap 52, the second inner side 60 is also somewhat convex in its preferred configuration. Similarly, in order to conform to the shape of a triangular-shaped notch or gap, such as the notch or gap 52 shown in FIG. 7, the insert member 50 has a generally triangular shape in elevation, as illustrated in FIGS. 9 and 10. It should be noted, however, that the exact shape of an insert member according to the present invention can vary according to the particular shape of a notch or gap to be filled in a particular sheet material component installation.

Figure 15:
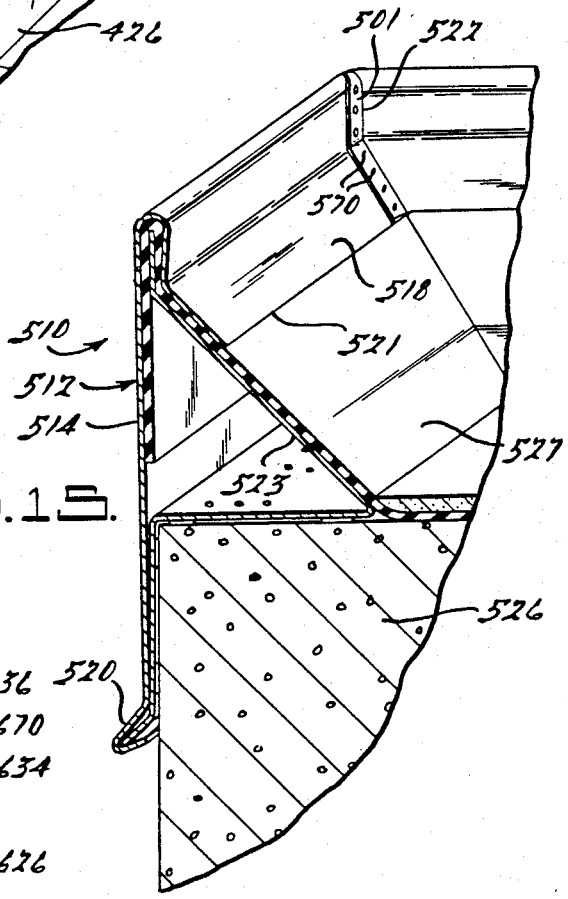
FIG. 15 is a view similar to that of FIG. 14, but similarly illustrating still another variation of the present invention.
Figure 16:
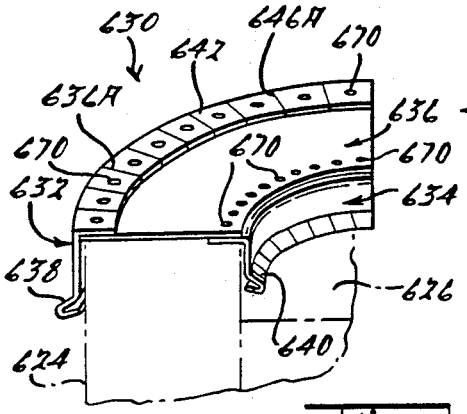
FIG. 16 is a partial perspective view, illustrating the application of the principles of the present invention in a generally arcuate or radiused corner portion of a fascia assembly according to the present invention.

FIGS. 15 and 16 illustrate the application of the principles of the present invention in gravel stop or raised roof edge assemblies 410 and 510, respectively, wherein there is only an outer fascia member (412 and 512, respectively), and no inner member is present. In these embodiments, a flange portion 401 or 501 is created when the sloped portions 418 or 518, respectively, are cut in order to fabricate the angulated corner configuration. Such flange portions 401 or 501 are then bent to a configuration allowing them to be secured to the adjacent sloped portions 418 or 518, respectively, in the manner described above in connection with the securement of the flange portions on the inner and outer members in the other illustrative embodiments shown and described herein.

It should be noted, however, that such flange portions 401 or 501 may not be necessary in all installations, since the assemblies 410 and 510 each include a waterproof roof member 427 and 527, respectively, that extends between the respective spring clips 423 and 523 and the respective fascia members 412 and 512. Thus the provision of the flange portions 401 and 501 may not be needed to prevent leakage in a given installation, but can be provided for providing additional strength, stiffening, or other purposes readily recognizable by one skilled in the art.

In addition, it should be noted that an insert member, such as the insert members 50 or 350 described above, would be provided to fill the gap or notch at the corner in the drip edges 420 or 520 in the same manner as described above. It should also be noted that examples of the type of gravel stop or raised roof edge assemblies 410 and 510, but without the features of the present invention, are disclosed in U.S. Pat. Nos. 4,071,987; 4,549,376; RE. 206,056, for example, while similar examples of coping assemblies of the type described herein are disclosed in U.S. Pat. No. 3,802,140.

Finally, as shown in FIG. 16, the principles of the present invention also apply to a fascia assembly, such as that illustrated by coping assembly 630, wherein the fascia assembly components are formed in a generally arcuate or curved configuration along an arcuate longitudinal path, thus forming a rounded corner of the assembly, for example. In such a construction, a number of cuts in the flanges 642 and 644, as well as the drip edges 638 and 640, must be made in order to facilitate bending the outer and inner face members 632 and 634, respectively, into the above-mentioned arcuate configuration.

As one skilled in the art will readily recognize, however, the principles of the present invention discussed above in connection with the method of making the coping assemblies according to the present invention are practically the same for the curved configuration shown in FIG. 16 and for the angulated configurations shown in FIGS. 2 through 16, except that in such a curved or arcuate arrangement, there is typically no need for the insert member described above. However, one skilled in the art will readily recognize that various insert members, generally similar to those shown in FIGS. 8 through 13 may in some instances be required in order to avoid unsightly or disadvantageous gaps in the outer drip edge 638 where irregular or unusual shapes are required. Although not specifically shown in the drawings, one skilled in the art will readily recognize that minor modifications may be required in the shape and configuration of the insert members shown in FIGS. 8 through 13 in order to better conform to the notches or gaps formed in outer drip edges or other portions of the components.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An insert member adapted for insertion into an opening in a portion of a sheet material coping member in order to substantially fill said opening, the coping member having a transversely-extending lip edge thereon, said opening being located in the lip edge generally at a corner of the coping member such that said opening is generally triangular in shape, said insert member comprising a body having lateral edges with grooves formed therein, said grooves being adapted to receive the sheet material coping member on opposite sides of said opening therein in order to retain said insert member in the opening, said body being generally triangular in shape, with said grooves being formed in two of the three sides of said triangular shaped body, said insert member being formed of a resilient elastomeric material, the width of said grooves being smaller than the thickness of the sheet material of said coping member prior to insertion of said insert member into said opening, said resilient elastomeric material of said insert member resiliently deflecting adjacent said grooves when said insert member is inserted into said opening in order to resiliently grip opposite sides of the sheet material of the coping member adjacent said opening, said body having first and second side portions, a portion of said first side portion extending laterally outward beyond said second side portion in order to define lateral flange portions, said second side portion having lateral ears thereon, said lateral ears and said lateral flange portions being spaced apart from one another to define said grooves therebetween.

2. An insert member according to claim 1, wherein said body of said insert member has a convex outer portion extending between said lateral edges.

3. An insert member according to claim 2, wherein said body of said insert member has a convex inner portion extending between said grooves.

4. An insert member according to claim 3, wherein said convex outer portion extends laterally beyond said convex inner portion in order to form lateral flange portions generally along said lateral edges, said convex inner portion having lateral ears thereon, said lateral ears and said lateral flange portions being spaced apart from one another to define said grooves therebetween.

* * * * *

UNITED STATES PATENT AND TRADEMARK OFFICE

CERTIFICATE OF CORRECTION

PATENT NO. : 4,909,006

DATED : March 20, 1990

INVENTOR(S) : Hickman, et al

It is certified that error appears in the above-identified patent and that said Letters Patent is hereby corrected as shown below:

Column 2, line 16, "fabricted" should be —fabricated—.

Column 4, line 8, "acccording" should be —according—.

Column 8, line 17, "16" should be —15—.

Signed and Sealed this

Twenty-second Day of January, 1991

*Attest:*

HARRY F. MANBECK, JR.

*Attesting Officer*

*Commissioner of Patents and Trademarks*